United States Patent [19]

Davis

[11] 4,163,968

[45] Aug. 7, 1979

[54] SUPERVISED LOOP ALARM RADIO TRANSMITTER SYSTEM

[75] Inventor: Manfred Davis, Riverdale, N.Y.

[73] Assignee: Transcience Industries, Inc., Stamford, Conn.

[21] Appl. No.: 884,934

[22] Filed: Mar. 9, 1978

[51] Int. Cl.[2] ..... G08B 25/00

[52] U.S. Cl. ..... 340/539; 340/510; 325/64

[58] Field of Search ..... 340/506, 510, 517, 539, 340/541; 325/37, 64; 343/225, 228

[56] References Cited

U.S. PATENT DOCUMENTS

| | | | |
|---|---|---|---|
| 2,871,466 | 1/1959 | Vassil et al. | 340/510 |
| 3,553,687 | 1/1971 | Reiss | 340/510 |
| 3,665,475 | 5/1972 | Gram | 325/37 |

*Primary Examiner*—Alvin H. Waring
*Attorney, Agent, or Firm*—Martin LuKacher

[57] ABSTRACT

In order to assure that an alarm signal is transmitted, whether in the case of a true alarm condition or tampering, whether advertent or inadvertent, without any significant increase in power requirements, an alarm radio transmitter system is provided with a supervised loop which controls an electronic switch for connecting the power source (a single battery) to energize the transmitter for a brief interval of time only when an alarm condition or tampering occurs. The supervised loop is part of a bridge circuit also connected to the power source which draws a minimum amount of current therefrom. The alarm radio transmitter system may be remotely located where attention is not available, since the battery need only be infrequently changed.

10 Claims, 1 Drawing Figure

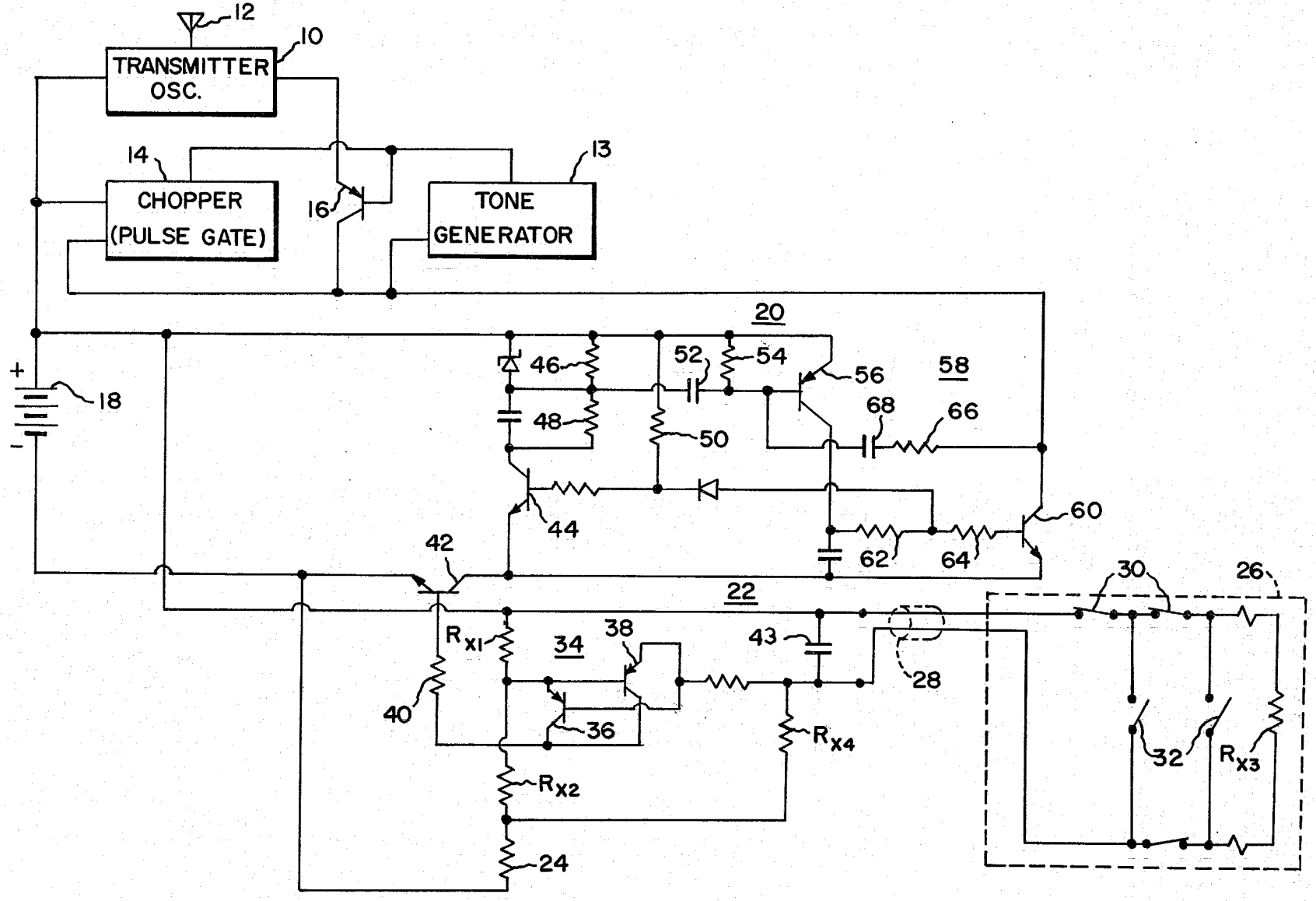
TRANSMITTER OSC.
CHOPPER (PULSE GATE)
TONE GENERATOR
10
12
13
14
16
18
20
22
24
26
28
30
32
34
36
38
40
42
43
44
46
48
50
52
54
56
58
60
62
64
66
68
$R_{x1}$
$R_{x2}$
$R_{x3}$
$R_{x4}$
+

SUPERVISED LOOP ALARM RADIO TRANSMITTER SYSTEM

The present invention relates to alarm systems and particularly to an alarm radio transmitter system.

The invention is especially suitable for use in alarm systems which are operated by power sources having limited life, such as batteries, in that the invention enables the alarm system to be supervised without any significant drain on the battery which would decrease the battery life and require frequent battery changing. By a supervised system is meant that the system is guarded against tampering, whether advertent or inadvertent, and provides an alarm whenever tampering occurs. Alarm systems must in many applications be remotely located and have self contained power sources, such as batteries. These alarm systems may be burglar or intruder alarms, fire or smoke detectors, or detectors of dangerous or other predetermined conditions in industrial equipment or processes. Power sources which are not limited in their capacity are oftentimes not available for use by such alarm systems, nor is the use of available power lines desirable for security reasons. It is therefore particularly desirable to use a single self-contained power source for operating the alarm system, and particularly a single battery.

An alarm radio transmitter system must be used in many applications, particularly when the detection of alarm conditions at remote unattended locations is necessary. The radio transmitter drains the power from the battery when it is operated. Means for supervising the system which would impose additional drain on the battery are undesirable. However, a supervised alarm system may be a necessary requirement for reasons of reliability and security.

It is an object of the present invention to provide an improved alarm radio transmitter system which is supervised without imposing significant increased power requirements on the source of power for the system.

It is a further object of the invention to provide an improved alarm radio transmitter system operated from a single power source, such as a battery, which has a supervised loop containing sensors for alarm conditions and which nevertheless is supervised without significantly decreasing the life time of the battery.

It is a still further object of the present invention to provide an improved supervised loop alarm radio transmitter system which is reliable in operation and inexpensive to manufacture.

Briefly described, an alarm radio transmitter system embodying the invention utilizes a radio transmitter which transmits an alarm signal when energized. A detector loop senses the alarm conditions and is supervised by a bridge circuit which includes the detector loop. The bridge circuit is unbalanced whenever an alarm condition is sensed or due to tampering. An electronic switch is operated in response to an unbalanced condition in the bridge circuit and is operative to energize the transmitter whenever an alarm condition or tampering is sensed. The entire system may be operated by a single source of electric current (e.g., a battery). The source is connected across the bridge circuit which introduces only negligible current drain. The source is connected across the transmitter through the electronic switch only when the alarm condition is sensed; the transmitter being otherwise inactive, such that it does not draw current from the source.

The foregoing and other objects, features and advantages of the invention as well as a presently preferred embodiment thereof will become more apparent from a reading of the following description in connection with the accompanying drawing which is a single FIGURE showing a schematic diagram of an alarm radio transmitter system embodying the invention.

Referring more particularly to the drawing, a transmitter oscillator 10 generates and transmits alarm radio signals via an antenna 12. These radio signals may be in the UHF band or other bands allocated to alarm and security systems. The transmitter oscillator 10 is modulated by a tone generator 13. The tone generator may be an audio oscillator which is intermittently excited by a chopper oscillator or pulse gate 14. The transmitter oscillator power and modulation is applied thereto by way of an emitter follower transistor 16.

The source of power for the entire transmitter system including the transmitter oscillator 10, the tone generator 13 and the chopper 14, is provided by a single source, preferably a battery 18. This battery may be a 9-volt battery which is conventionally used for powering transistorized equipment. Current from the battery passes through the transmitter oscillator 10 and the emitter follower 16 during the period of time that the pulse gate provided by the chopper 14 is enabled. The tone generator 13 is then also energized and the transmitter oscillator is capable of transmitting a radio alarm signal. The transmitter system also includes a timer circuit 20 and a supervised loop alarm condition detector circuit 22 which prevent the transmitter oscillator 10, the tone generator 13 and the chopper 14, from being energized except for a predetermined period of time when an alarm condition is detected. The design of the transmitter oscillator 10, tone generator 13 and chopper 14 may be generally similar to the designs described in U.S. Pat. No. 3,665,475, issued May 23, 1972 in the name of Herbert R. Gram.

The supervised loop alarm detector 22 contains a bridge circuit having four impedance elements, shown as resistors Rx1, Rx2, Rx3, and Rx4, in the arms thereof. This bridge circuit is connected across the battery 18 through a resistor 24 which has a high value of resistance, e.g., 1 megohm. The values of the resistances Rx1, Rx2, Rx3 and Rx4, are equal and may also be high resistances, say of the order of 200 kiloohm. Accordingly, the current drain on the battery due to the bridge circuit is insignificant and does not appreciably diminish the life of the battery. The arm of the bridge containing the resistor Rx3 also contains the supervised loop 26. This loop may be at a point remote from the rest of the transmitter system and may be connected thereto by an armored cable 28 for security reasons. The loop includes sensors represented as normally closed switches 30 in series with the bridge resistor Rx3 and normally open switches 32 in parallel with that bridge resistor Rx3. The switches may be conductive tape on windows which are normally closed but open when the window is broken, or switches in doors which are normally open or normally closed when the door is open. Other sensor devices such as are usually included in burglar alarms or smoke devices and provide effectively normally open and normally closed circuits may be used in the loop 26.

Across the detector arm of the bridge, i.e., between the junction of Rx1 and Rx2 and the junction of Rx3 and Rx4, there is located electronic switch means 34. This switch means is provided by a bidirectional amplifier having two transistors 36 and 38. Inputs to the amplifier are from the junction of the resistors Rx1 and Rx2 and the resistors Rx3 and Rx4. The current path through the transistors 36 and 38 is through a common output resistor 40 which is connected to the base of a switching transistor 42. The switching transistor 42 is also part of the electronic switch. A capacitor 43 serves as an electrical noise suppressor. If any of the normally open switches 32 close, or if by tampering, whether advertent or inadvertent, a short circuit is placed across the loop 26, the bridge becomes unbalanced and current flows through the transistor 36 since its base goes negative with respect to its emitter. This current flows through the output resistor 40 and turns the switching transistor 42 on. Similarly if any of the normally closed switches 30 open or if the circuit path in series with the resistor Rx3 is broken, current flows through the other transistor 36 since its emitter potential rises with respect to the potential at its base. Again, output current flows through the transistor 36 and the output resistor 40 causing the base of the transistor 42 to become more positive than its emitter and the transistor 42 is turned on.

In the timer 20, a transistor 44 of a pulse generator circuit is turned abruptly on when the transistor switch 42 becomes conductive. A small amount of current is drawn by the generator transistor 44 since the resistors 46 and 48 in its collector circuit may be of high value, suitably 1 megohm each and a resistor 50 in its base circuit may also be of high value, e.g., also 1 megohm. A capacitor 52 and resistor 54 translates the initial current flow through the transistor 44 into a negative voltage pulse which is applied to the base of a transistor 56 in a one-shot multivibrator circuit 58. The other transistor 60 of the one-shot miltivibrator is simultaneously turned on through the resistors 62 and 64 and the transistors 60 and 56 stay on (viz., fully conductive) until a resistance capacitance timing circuit consisting of the resistor 66 and capacitor 68 discharges. The time constant of this circuit may be for example 2000 milliseconds. The transistor 60 then stays conductive for approximately this period of 2000 milliseconds which is the timing period of the timer circuit 20. Current flow through the resistors 62 and 64 is also applied to the base of the pulse generator transistor 44 and turns that transistor on harder. While the multivibrator transistor 60 is conductive, a current path for energizing the transmitter oscillator 10, the tone generator 13 and the chopper 14 from the battery 18 is completed through the transistor 60 and the switching transistor 42. Accordingly, the transmitter oscillator, tone generator and chopper, which are the principal current drain on the battery 18, are only operated briefly, say for approximately 2000 milliseconds upon the detection of an alarm condition; thus further conserving battery power.

From the foregoing description it will be apparent that there has been provided an improved alarm radio transmitter system having a supervised detection loop which imposes minimal current drain on a battery which powers the entire system. Supervised operation is provided without significant increase in power drain on the battery. While a presently preferred embodiment of the invention has been described, variations and modifications within the scope of the invention will undoubtedly suggest themselves to those skilled in the art. Accordingly, the foregoing description should be taken merely as illustrative and not in any limiting sense.

What is claimed is:

1. An alarm radio transmitter system which comprises radio transmitter means for transmitting an alarm signal when energized, detector loop means for sensing alarm conditions, means defining a bridge circuit including said detector loop means in at least one arm thereof for unbalancing said bridge circuit when an alarm condition is sensed, and an electronic switch means for disconnecting operating power from said transmitter means and coupled to said bridge circuit means to energize said transmitter means only when said alarm condition is sensed.

2. The invention as set forth in claim 1 further comprising a single source of electric current for energizing said alarm radio transmitter system, said source being connected across said bridge circuit means, said source being connected across said transmitter means through said electronic switch means.

3. The invention as set forth in claim 2 wherein said source is a battery.

4. The invention as set forth in claim 2 wherein said bridge circuit has first and second arms connected across said source, said bridge circuit also having third and fourth arms also connected across said source, said one arm being one of said first, second, third and fourth arms, said arms having impedance elements of equal value, means for limiting the current flow from said source through said bridge, said detector loop means including the impedance element of said one arm and sensing means for varying the impedance presented to said bridge by said one arm in response to alarm conditions, and said electronic switch means including circuit means connected between the junctions of said first and second arms and said third and fourth arms for detecting current flow therethrough and switching means connected in series with said source to said transmitter means operated by said circuit means in response to the detection of said current flow.

5. The invention as set forth in claim 4 wherein said sensing means comprises normally open and normally closed switches, said normally closed ones of said switches being connected in series with said impedance element of said one arm and said normally open ones of said switches being connected across said impedance element of said one arm.

6. The invention as set forth in claim 5 including a cable connecting said sensing means switches and said impedance element of said one arm from a first point to the rest of said bridge circuit means at a second point, said points being remote from each other, said transmitter means being located at said second point.

7. The invention as set forth in claim 5 wherein said impedance elements are resistors, said circuit means is a bidirectional amplifier having inputs connected to different ones of said junctions and an output for output current from said bidirectional amplifier, said switching means is a transistor having a collector, a base and an emitter, said collector and emitter being connected in series with said source, and said base being connected to said bidirectional amplifier output.

8. The invention as set forth in claim 2 wherein said transmitter means includes timer means also connected across said source through said electronic switch means for energizing said transmitter means for a predetermined interval of time when said alarm condition is sensed.

9. The invention as set forth in claim 8 wherein said timer means comprises means for generating a pulse when said source is connected to said timer means, and a one shot multivibrator triggered by said pulse having a transistor switch which is closed for said predetermined interval in response to said pulse.

10. The invention as set forth in claim 9 wherein said transmitter means further includes a transmitter oscillator, and means for modulating said oscillator, said oscillator and modulating means being connected across said source through said one shot multivibrator transistor switch.

* * * * *